US007187339B2

(12) United States Patent
Mori

(10) Patent No.: US 7,187,339 B2
(45) Date of Patent: Mar. 6, 2007

(54) ANTENNA APPARATUS

(75) Inventor: Kohei Mori, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 11/033,382

(22) Filed: Jan. 12, 2005

(65) Prior Publication Data

US 2005/0162327 A1 Jul. 28, 2005

(30) Foreign Application Priority Data

Jan. 23, 2004 (JP) ..... P2004-016186

(51) Int. Cl.
*H01Q 13/10* (2006.01)

(52) U.S. Cl. ..... 343/770; 343/700 MS; 343/768

(58) Field of Classification Search ..... 343/700 MS, 343/702, 819, 815, 833, 834, 767, 768, 770
See application file for complete search history.

(56) References Cited

U.S. PATENT DOCUMENTS

| | | | | |
|---|---|---|---|---|
| 3,541,559 | A * | 11/1970 | Evans | 343/756 |
| 3,623,109 | A * | 11/1971 | Neumann | 343/815 |
| 4,631,546 | A * | 12/1986 | Dumas et al. | 343/833 |
| 4,812,855 | A * | 3/1989 | Coe et al. | 343/818 |
| 5,220,335 | A * | 6/1993 | Huang | 343/700 MS |
| 6,320,544 | B1 * | 11/2001 | Korisch et al. | 343/700 MS |
| 6,606,057 | B2 * | 8/2003 | Chiang et al. | 342/374 |
| 6,888,505 | B2 * | 5/2005 | Tran | 343/834 |
| 2002/0105471 | A1 * | 8/2002 | Kojima et al. | 343/819 |

FOREIGN PATENT DOCUMENTS

| | | |
|---|---|---|
| JP | 35-6916 | 6/1935 |
| JP | 53-40733 | 4/1978 |
| JP | 11-027038 | 1/1999 |
| JP | 2000-077929 | 3/2000 |
| JP | 2002-330024 | 11/2002 |
| JP | 2003-142919 | 5/2003 |
| WO | WO 03/058758 A1 | 7/2003 |

OTHER PUBLICATIONS

Notification of Reasons for Refusal, Application No. 2004-016186, Drafting date: Aug. 4, 2006.

* cited by examiner

*Primary Examiner*—Hoang V. Nguyen
*Assistant Examiner*—Ephrem Alemu
(74) *Attorney, Agent, or Firm*—Rader Fishman & Grauer PLLC; Ronald P. Kananen

(57) ABSTRACT

In order to have an antenna apparatus small in size and capable of switching its directivity pattern without degrading its antenna efficiency, the present invention provides an antenna apparatus having a driven element formed at an approximately center position of a planar printed circuit board and parasitic elements not performing feeding formed before and behind the first antenna element, respectively, so that the driven element is caused to function as a radiator and either one of the parasitic elements is made to have a length as long as an electrical length of a radiator or slightly shorter than that to function as a director and the other one of the parasitic elements is left to have an electrical length longer than that of the radiator to function as a reflector.

9 Claims, 16 Drawing Sheets

AVERAGE GAIN (MEASURED VALUE) : dBi -6.80dBi

SLOT WIDTH OF 2mm
FR-4 BOARD (40mm SQUARE AND 1mm THICK)

—— Eφ

------- Eθ

AVERAGE GAIN 3.402dBi 2.692dBi

AVERAGE GAIN 3.337dBi

FIG. 13

| | #1 | #2 | #3 | #4 | REFERENCE ANTENNA |
|---|---|---|---|---|---|
| MAXIMUM GAIN | 2.33[dBi] | 1.67 | 2.4 | 1.69 | 2.5 |
| AVERAGE GAIN (XY-PLANE) | -10.95 | -9.87 | -10.9 | -8.96 | — |
| AVERAGE GAIN (XZ-PLANE) | -6.12 | -5.29 | -7.84 | -7.32 | — |
| AVERAGE GAIN (YZ-PLANE) | -8.15 | -6.05 | -6.32 | -5.29 | — |
| AVERAGE GAIN (RADIAL DIRECTION) | -1.46 | -2.75 | -1.52 | -2.95 | -4.63 |

1dB IS ALLOWED FOR SW INSERTION LOSS

PRIOR ART

PRIOR ART

ANTENNA APPARATUS

CROSS REFERENCES TO RELATED APPLICATIONS

The present document is based on Japanese Priority Document JP 2004-016186, filed in the Japanese Patent Office on Jan. 23, 2004, the entire contents of which being incorporated herein by reference.

BACKGROUND OF THE INVENTION

1. Field of the Invention

The present invention relates to an antenna apparatus capable of performing a switching of a directivity pattern.

2. Description of Related Art

Conventionally, it is known that a use of an antenna having no directivity pattern leads to a degradation of a communication quality with an interference wave caused by a reflection from a building wall etc. in a multipath propagation environment in which multiple radio waves are available. Thus, an antenna apparatus capable of turning a directivity pattern in a specific direction has attracted attention.

A phased array antenna apparatus shown in FIG. 15 and an adaptive array antenna apparatus shown in FIG. 16 are known as such an antenna apparatus capable of turning a directivity pattern in a specific direction. The phased array antenna apparatus shown in FIG. 15 has N pieces of antenna elements 101-1, 101-2, . . . and 101-N. Then, an amplification of signals having been received by the N pieces of antenna elements 101-1, 101-2, . . . and 101-N is performed by amplifiers (AMP) 102-1, 102-2, . . . and 102-N. The received signals having been amplified by the amplifiers 102-1, 102-2, . . . and 102-N are outputted to a synthesizer 104 after phase adjustment-by variable phase shifters (phase shifters) 103-1, 103-2, . . . and 103-N. The synthesizer 104 performs a synthesis of the received signals from the respective variable phase shifters 103-1, 103-2, . . . and 103-N. A frequency converter (a down-converter) 105 is operated to output the resultant received signal obtained by the synthesizer 104 through a conversion into a signal of a lower frequency.

An adaptive array antenna shown in FIG. 16 has N pieces of antenna elements 111-1, 111-2, . . . and 111-N. In the adaptive array antenna of this type, the amplification of signals having been received by the N pieces of antenna elements 111-1, 111-2, . . . and 111-N is performed by amplifiers (AMP) 112-1, 112-2, . . . and 112-N at the time of a receiving operation of the above antenna. Then, the received signals having been amplified by the amplifiers 112-1, 112-2, . . . and 112-N are respectively down-converted (DC) by frequency converters 113-1, 113-2, . . . and 113-N and subsequently undergo an analog signal-to-digital signal conversion by AD/DA converters 114-1, 114-2, . . . and 114-N. Following the conversion, an output of the obtained digital signals is performed through a so-called adaptive signal processing such as weighting and synthesizing with a digital signal processing unit 115.

On the contrary, at the time of a transmitting operation, digital transmitting signals having been given a required signal processing by the digital signal processing unit 115 are converted into analog transmitting signals with the AD/DA converters 114-1, 114-2, . . . and 114-N and subsequently undergo an up-conversion (UC) with the frequency converters 113-1, 113-2, . . . and 113-N. Following the conversion, the amplification is performed by the amplifiers 112-1, 112-2, . . . and 112-N, leading to a transmission (a radiation) from the antenna elements 111-1, 111-2, . . . and 111-N.

However, the phased array antenna as shown in FIG. 15 requires that a receiving system should be configured with a plurality of variable phase shifters 103-1 to 103-N at a high frequency band. Further, the adaptive array antenna as shown in FIG. 16 requires that the adaptive signal processing should be performed using a plurality of transmitting/receiving systems. For the above reasons, both of the above antenna apparatuses call for a complicated system and costs much, resulting in a difficult application to a consumer apparatus requiring to be produced at low cost.

By the way, a Yagi-Uda antenna widely used for a reception of television broadcasting is well known as an antenna having a directivity pattern in a specific direction. The Yagi-Uda antenna shown in FIG. 17A comprises a radiator 121 that radiates a radio wave, a director 122 having an electrical length slightly smaller than an electrical length ($2/\lambda g$, where $\lambda g$ is a guide wavelength) of the radiator 121 and a reflector 123 having an electrical length slightly longer than the electrical length of the radiator 121, wherein the director 122 and the reflector 123 are disposed before and behind the radiator 121 to ensure that the directivity as shown in FIG. 17B is obtained.

Then, a patent document 1 proposes an antenna apparatus that is configured on the basis of the above Yagi-Uda antenna to ensure that a switching of a direction of the directivity is performed. Further, a patent document 2 proposes an antenna apparatus in which a sharing of a director is applied to attain a reduction in antenna size, with reference to an antenna apparatus that performs the switching of a feed point to ensure that a formation of multi-beams is attained.

[Patent document 1] Japanese Patent Application Publication (KOKAI) No. Hei 11-27038

[Patent document 2] Japanese Patent Application Publication (KOKAI) No. 2003-142919.

SUMMARY OF THE INVENTION

However, the antenna apparatus of the above patent document 1 is in the form of an array of multiple Yagi-Uda antennas, and thus requires more than one director and more than one reflector, resulting in a disadvantage of being difficult to downsize. Further, the antenna apparatus of the above patent document 1 is supposed to be of a structure in which a monopole antenna is projecting in a vertical direction of a ground plate, also resulting in a difficulty in attaining a reduction in thickness. Alternatively, it is also suggested that a dipole antenna should be used in place of the monopole antenna, for instance, to form the antenna on a printed circuit board, in which case, however, the ground plate fails to be disposed in the vicinity of the antenna, resulting in a difficult packaging of a selector switch etc. Further, the monopole antenna, even if formed with a dielectric substance, has little effect of shortening a wavelength, resulting in a disadvantage of being difficult to downsize.

The antenna apparatus of the above patent document 2 applies the sharing of the director to reduce an antenna size, so that there is a limitation to the downsizing. Further, the antenna apparatus of the above configuration needs a selector switch between transmitting and receiving systems for each beam direction to attain the formation of multi-beams, resulting in a disadvantage in that the selector switch leads to a degradation of efficiency as the antenna. Furthermore, the antenna apparatus of the above configuration is basically supposed to have one transmitting/receiving system, so that a one-to-multiple switching is required for the selector switch, resulting in a disadvantage of being very difficult of a manufacturing adaptive to an available frequency band of a radio communication.

Thus, the present invention has been undertaken in view of the above problems, and is intended to provide an antenna apparatus being small in size and capable of performing the switching of a directivity pattern without degrading its antenna efficiency.

To attain the above object, an antenna apparatus according to the present invention comprises a driven element having a prescribed electrical length, parasitic elements respectively having an electrical length longer than that of the driven element and disposed at the opposite sides of the driven element and changing means for changing each electrical length of the parasitic elements.

According to the above configuration, changing of each electrical length of the parasitic elements disposed at the opposite sides of the driven element is performed by the changing means to ensure that the parasitic elements disposed at the opposite sides of the driven element are set to function as a director or a reflector.

Thus, according to the present invention described above, an antenna apparatus being small in size and capable of performing a switching of the directivity may be realized. Further, the present invention includes switching the directivity of the antenna by changing each electrical length of the parasitic elements, so that there is no need for the driven element to have a selector switch etc. for switching over the directivity, resulting in no efficiency degradation of the antenna.

BRIEF DESCRIPTION OF THE DRAWINGS

FIG. 13 is a table showing maximum gains and average gains of the Yagi slot antenna specified as another embodiment and a reference antenna.

DESCRIPTION OF PREFERRED EMBODIMENTS

A structure of an antenna apparatus specified as an embodiment of the present invention is hereinafter described. Incidentally, the embodiment of the present invention is described by taking a case of an antenna apparatus suitable to a wireless LAN (Local Area Network) in which a radio wave of 5.2 GHz band, for instance, is available.

Figure 1A:
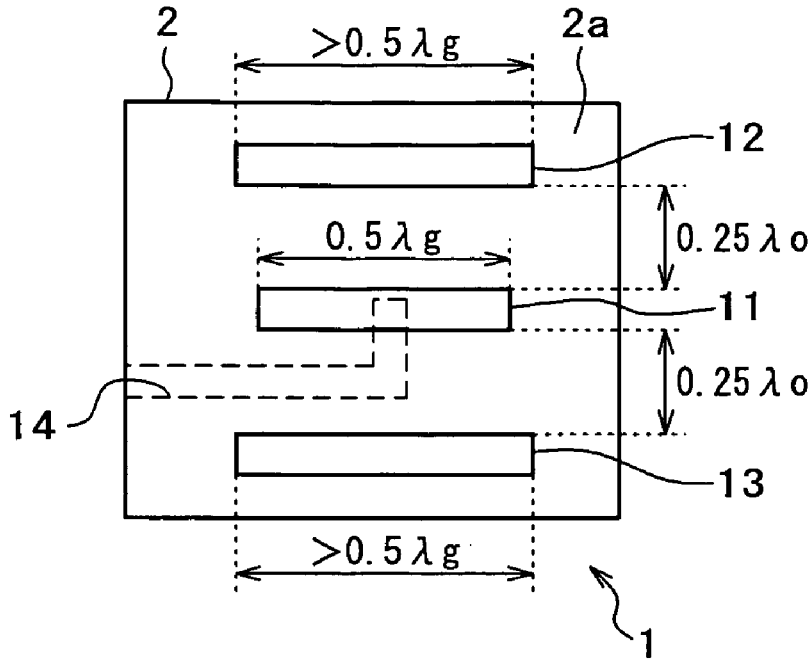
FIG. 1, consisting of FIG. 1A and FIG. 1B, is a view for illustrating a configuration of a Yagi slot antenna specified as an embodiment of the present invention.

FIG. 1A is a view showing a configuration of a slot antenna that forms the basis of the antenna apparatus specified as the embodiment of the present invention. A slot antenna 1 shown in FIG. 1A has, at an approximately center position of a planar printed circuit board 2, a driven element 11 given a feed, and before and behind the driven element 11, parasitic elements 12 and 13 respectively given no feed. Then, the slot antenna 1 having the above configuration is supposed to be capable of radiating radio waves from the driven element 11.

The driven element 11 is in the form of a slot (a slit) provided in a conductor (a ground plate) 2*a* formed at one surface side of the planar printed circuit board 2, for instance. The driven element 11 is given the feed with a micro-strip transmission line 14 formed at the other surface side of the planar printed circuit board 2. Each of the parasitic elements 12 and 13 is also in the form of a slot provided in the conductor 2*a* of the planar printed circuit board 2, for instance.

In this case, a slot length (an electrical length) of the driven element 11 is specified as a length equivalent to a ½ wavelength (0.5 $\lambda g$) of a transmitting/receiving frequency required for the slot antenna 1 to perform a transmission and a reception. Each slot length (the electrical length) of the parasitic elements 12 and 13 is supposed to be longer than the slot length (0.5 $\lambda g$) of the driven element 11. Further, the driven element 11 and the parasitic elements 12 and 13 are spaced at intervals of about ¼ wavelength (0.25 $\lambda o$, where $\lambda o$ represents a free space wavelength), respectively.

Figure 1B:
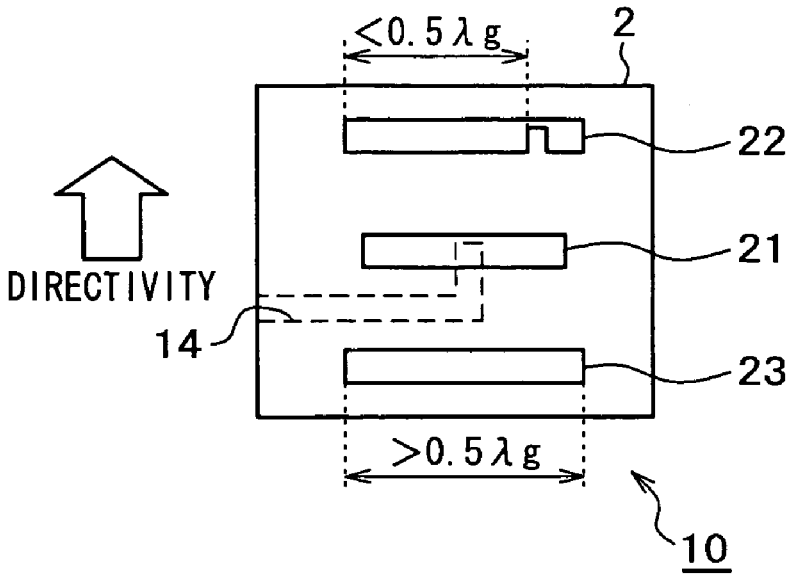

Then, the antenna apparatus of the embodiment of the present invention ensures that the antenna apparatus is configured using the slot antenna 1 having the above structure. FIG. 1B is a view showing the configuration of a Yagi slot antenna available as the antenna apparatus of the embodiment of the present invention. A Yagi slot antenna 10 shown in FIG. 1B sets the driven element 11 of the slot antenna 1 shown in FIG. 1A to function as a radiator 21 as it is. As to the parasitic element 12 similarly shown in FIG.

1A, a function as a director 22 is provided by means of making the electrical length thereof equal to or slightly shorter than the electrical length (the ½ wavelength) of the radiator 21. As to the parasitic element 13, a function as a reflector 23 is provided by means of taking advantage of the electrical length longer than the electrical length of the driven element 11 as it is. Thus, a directivity of the Yagi slot antenna 10 of the embodiment of the present invention as shown in FIG. 1B is directed as shown by an arrow, that is, in a direction from the radiator 21 toward the director 22.

Incidentally, in the present specification, the electrical length required to set the parasitic elements 12 and 13 to function as the director 22 is hereinafter referred to as a director length. Further, the electrical length required to set the parasitic elements 12 and 13 to function as the reflector 23 is referred to as a reflector length. Further, in the slot antenna, there is a change of a resonant frequency also depending on a dielectric constant of a board material of the planar printed circuit board 2, so that each electrical length of the driven element 11 and the parasitic element 12 is determined in consideration of the dielectric constant etc. of the planar printed circuit board 2.

Figure 2A:
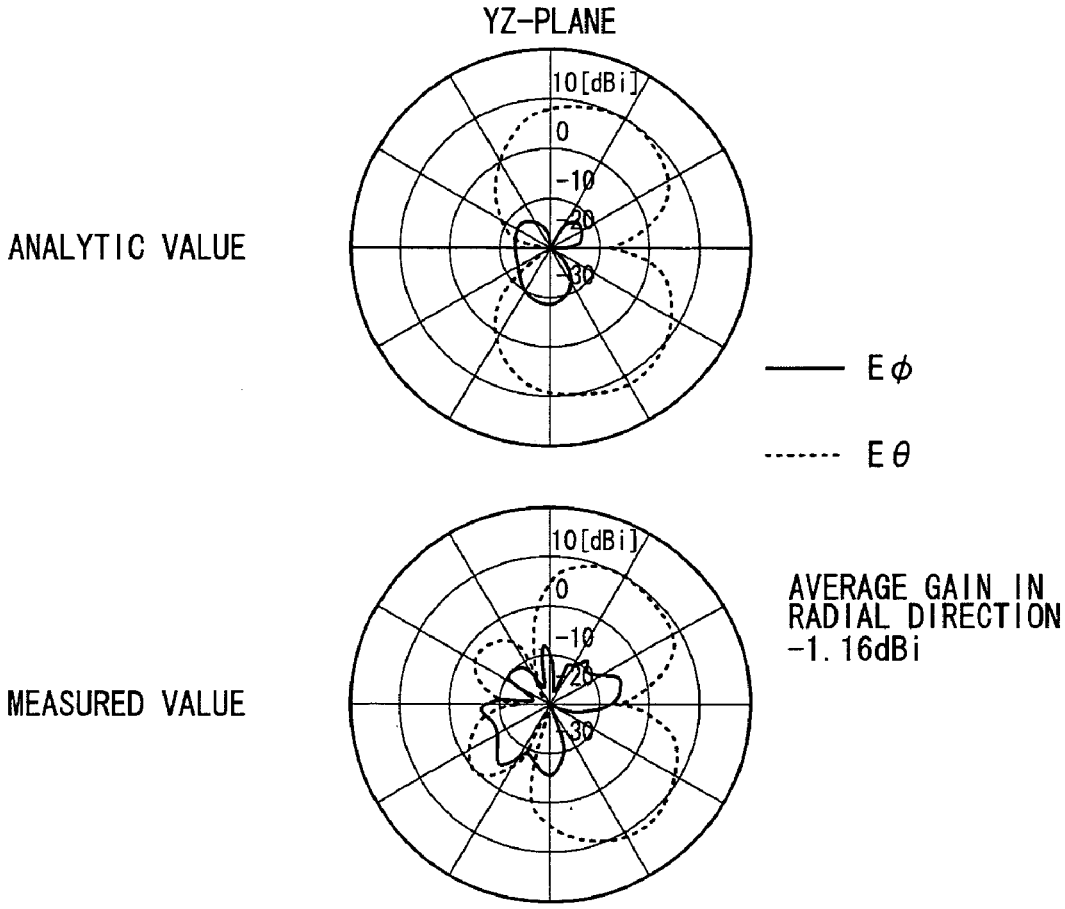
FIG. 2, consisting of FIG. 2A and FIG. 2B, is a view showing directivity patterns of the Yagi slot antenna of the embodiment of the present invention.
Figure 2B:
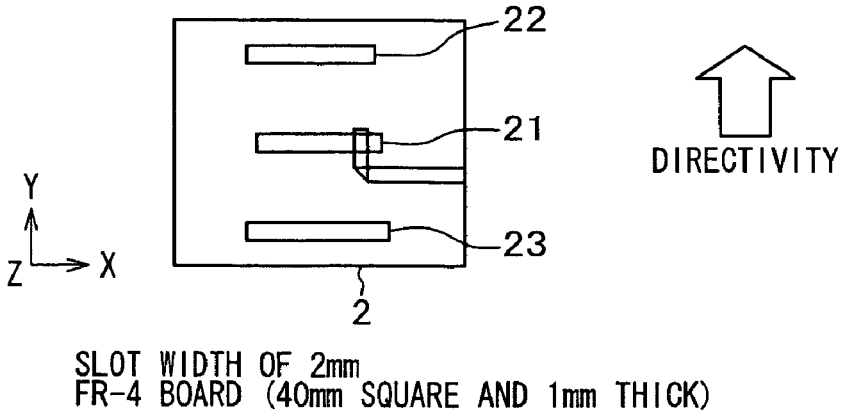

FIGS. 2 and 3 are views showing directivity patterns of the Yagi slot antenna 10 shown in FIG. 1B. Incidentally, each of the directivity patterns shown in FIGS. 2 and 3 is assumed to be one obtained when the planar printed circuit board 2 has thereon the director 22, the radiator 21 and the reflector 23 that are 2 mm in slot width and respectively 18 mm, 17 mm and 20.5 mm in slot length. Further, a FR-4 board formed with a glass epoxy resin having a planar size of 40 mm×40 mm, a thickness of 1 mm and a dielectric constant of 4.2 as a material is used for the planar printed circuit board 2. Further, the directivity pattern shown in FIG. 2B is assumed to be one obtained when a length direction of the slot, a width direction of the slot and a thickness direction of the printed circuit board 2 are specified as a X-direction, a Y-direction and a Z-direction, respectively.

Analytic values and measured values of the directivity patterns of a horizontal polarized wave Eϕ and a vertical polarized wave Eθ in a YZ-plane of the above Yagi slot antenna 10 are given as shown in FIG. 2A, wherein it may be appreciated that the direction of the directivity undergoes a control by the director 22 and the reflector 23. Incidentally, the measured value of an average gain in this case is assumed to be −6.05 dBi, and an average gain in a radial direction is assumed to be −1.16 dBi.

Figure 3A:
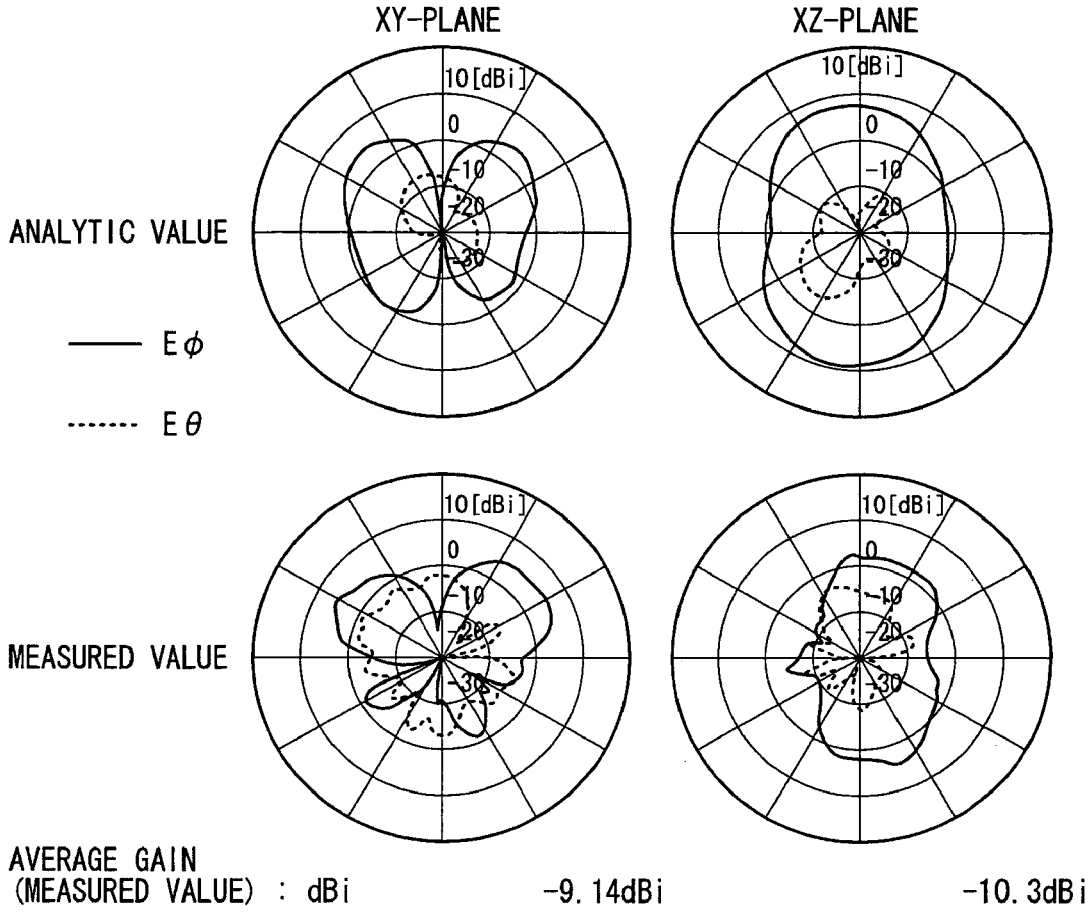
FIG. 3, consisting of FIG. 3A and FIG. 3B, is a view showing the directivity patterns of the Yagi slot antenna of the embodiment of the present invention.

For reference, the analytic values and the measured values of the directivity patterns of the horizontal polarized wave Eϕ and the vertical polarized wave Eθ in an XY-plane and an XZ-plane of the Yagi slot antenna 10 are given as shown in FIG. 3A, and the respective average gains (the measured values) are assumed to be −9.14 dBi and −10.3 dBi.

Figure 3B:
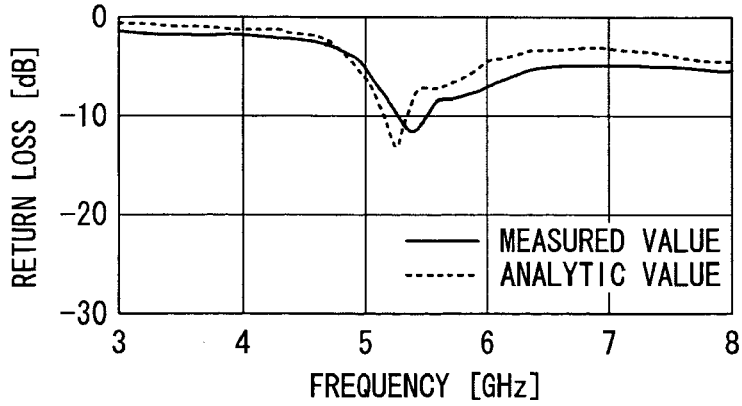

FIG. 3B is a view showing an input feature of the Yagi slot antenna 10 shown in FIG. 1B, wherein it may be appreciated from the input feature in FIG. 3B that the Yagi slot antenna 10 causes a resonance with the length of the radiator 21 assumed to be about a ½ wavelength of the guide wavelength.

Figure 4A:
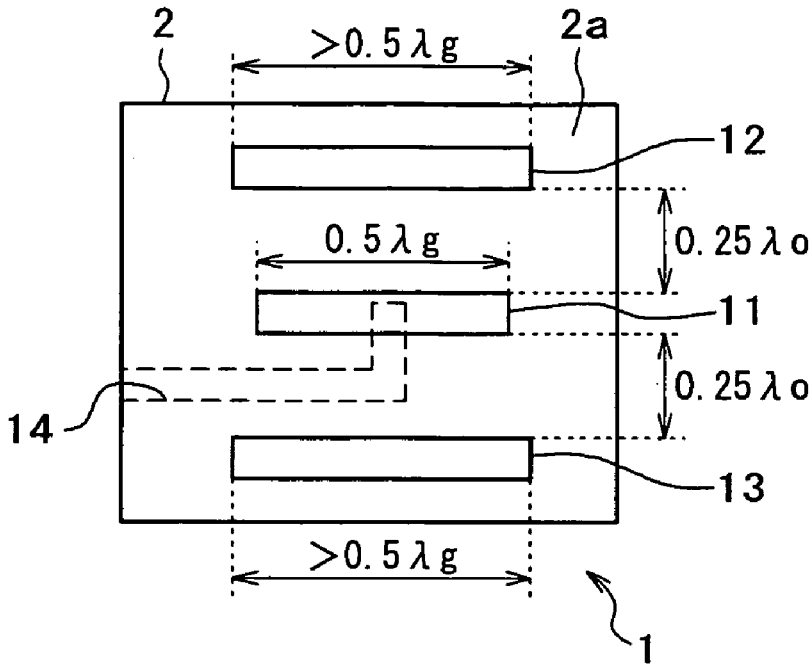
FIG. 4, consisting of FIG. 4A and FIG. 4B, is a view illustrating a different configuration of the Yagi slot antenna of the embodiment of the present invention.

The Yagi slot antenna 10 of the embodiment of the present invention ensures that an antenna apparatus having different directions of the directivity is configured by taking advantage of the above slot antenna 1. FIG. 4A is a view showing the slot antenna 1 that forms the basis of the Yagi slot antenna 10 specified as the embodiment of the present invention, wherein the above slot antenna 1 is supposed to have the same configuration as the slot antenna in FIG. 1A.

Figure 4B:
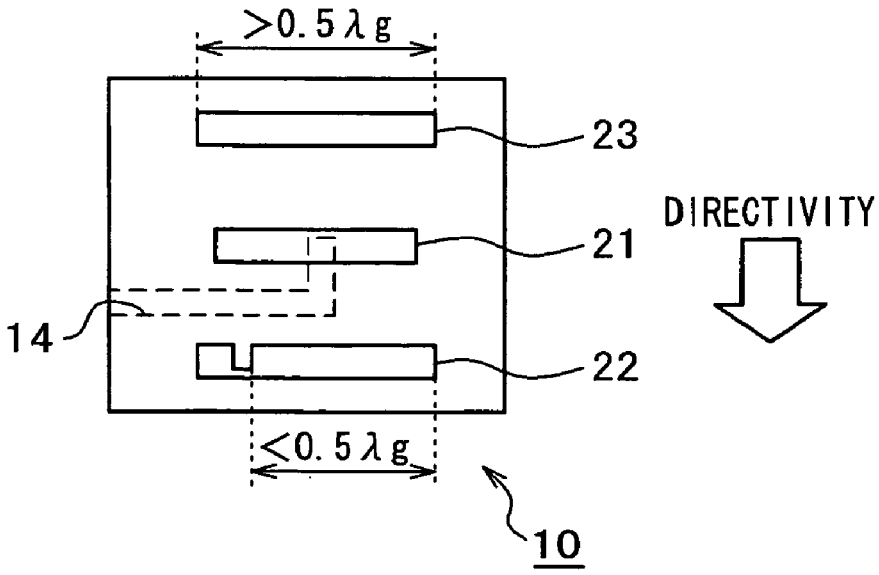

The Yagi slot antenna 10 in this case sets the driven element 11 shown in FIG. 4A to function as the radiator 21 as it is, as shown in FIG. 4B. In addition to the above, the function as the reflector 23 is provided by means of setting the electrical length of the parasitic element 12 at the reflector length, while the function as the director 22 is provided by means of setting the electrical length of the parasitic element 13 at the director length.

In other words, the Yagi slot antenna 10 shown in FIG. 4B is supposed to set the parasitic element 12 having been set to function as the director 22 in FIG. 1B to function as the reflector 23, and the parasitic element 13 having been set to function as the reflector 23 to function as the director 22. Thus, the directivity of the Yagi slot antenna 10 of the embodiment of the present invention shown in FIG. 4B is directed as shown by an arrow in FIG. 4B, resulting in the opposite direction to that shown in FIG. 1B.

Figure 5A:
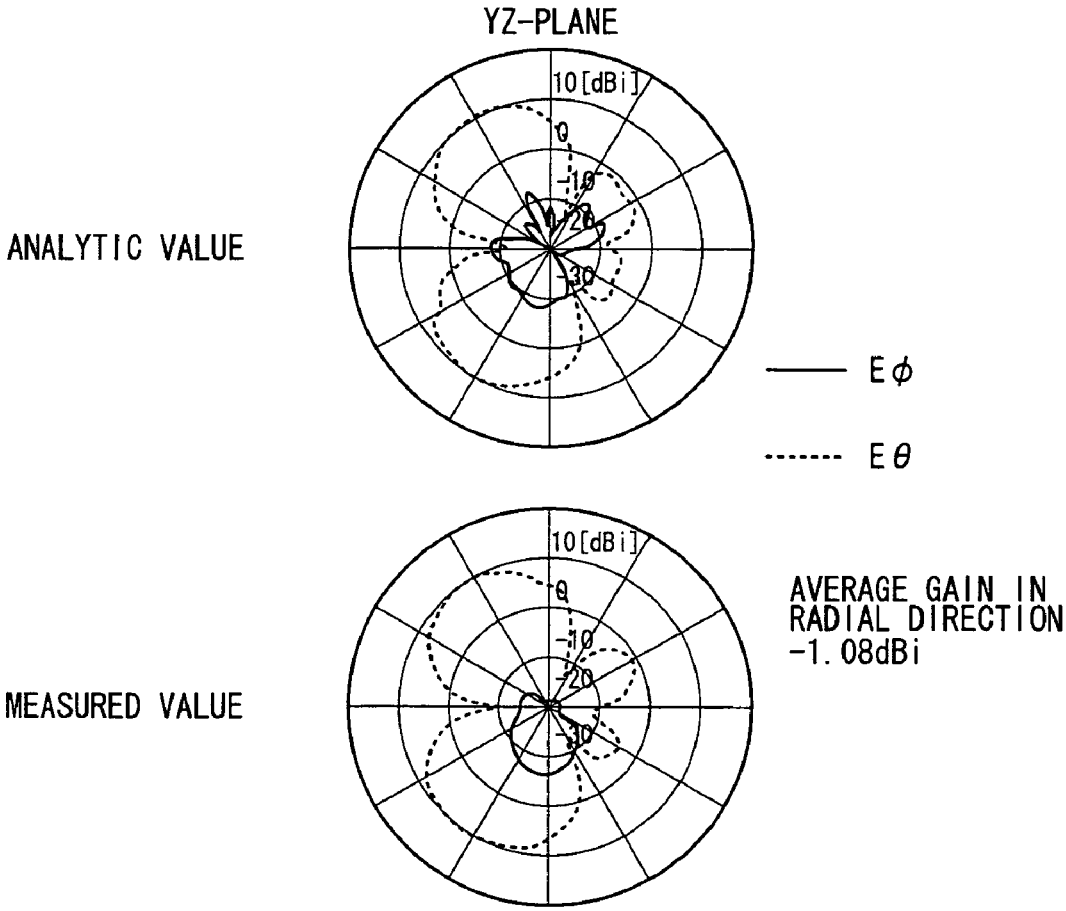
FIG. 5, consisting of FIG. 5A and FIG. 5B, is a view showing the directivity patterns of the Yagi slot antenna of the embodiment of the present invention.
Figure 5B:
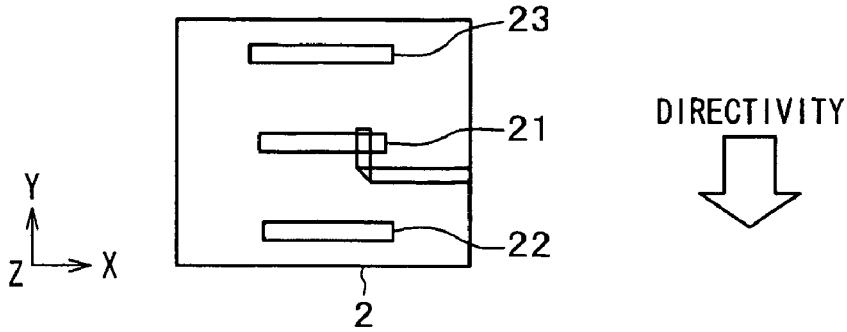

FIGS. 5 and 6 are views showing the directivity patterns of the Yagi slot antenna 10 shown in FIG. 4B. Incidentally, each of the directivity patterns shown in FIGS. 5 and 6 is also assumed to be one obtained when the planar printed circuit board 2 has thereon the director 22, the radiator 21 and the reflector 23 that are 2 mm in slot width and respectively 18 mm, 17 mm and 20.5 mm in slot length. Further, the FR-4 board formed with the glass epoxy resin having the planar size of 40 mm×40 mm, the thickness of 1 mm and the dielectric constant of 4.2 as the material is also used for the planar printed circuit board 2. Further, the directivity pattern shown in FIG. 5B is assumed to be one obtained when the length direction of the slot, the width direction of the slot and the thickness direction of the planar printed circuit board 2 are specified as the X-direction, the Y-direction and the Z-direction, respectively.

The analytic values and the measured values of the directivity patterns of the horizontal polarized wave Eϕ and the vertical polarized wave Eθ in the YZ-plane of the above Yagi slot antenna 10 are given as shown in FIG. 5A, wherein it may be also appreciated that the direction of the directivity undergoes the control by the director 22 and the reflector 23. Incidentally, the measured value of the average gain in this case is assumed to be −6.80 dBi, and the average gain in the radial direction is assumed to be −1.08 dBi.

Figure 6A:
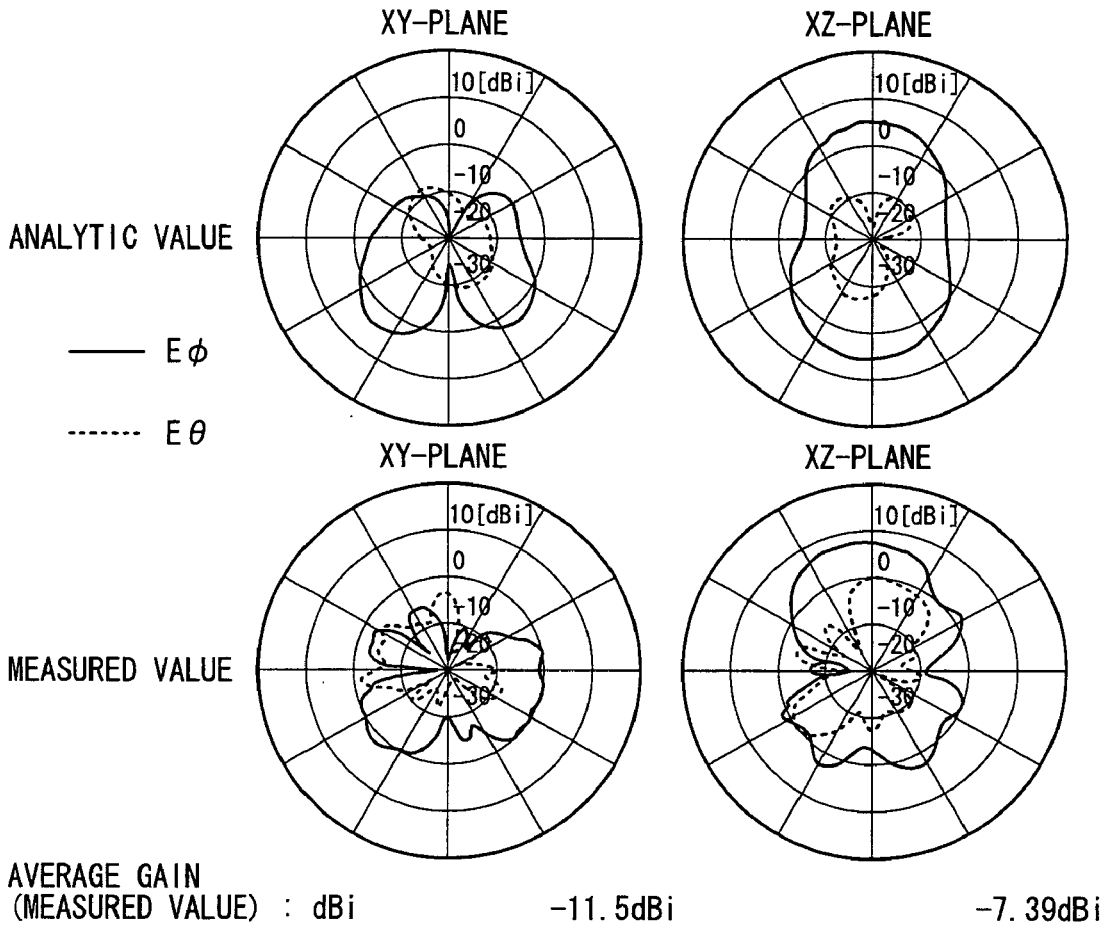
FIG. 6, consisting of FIG. 6A and FIG. 6B, is a view showing the directivity patterns of the Yagi slot antenna of the embodiment of the present invention.

For reference, the analytic values and the measured values of the directivity patterns of the horizontal polarized wave Eϕ and the vertical polarized wave Eθ in the XY-plane and the XZ-plane of the Yagi slot antenna shown in FIG. 4B are given as shown in FIG. 6A, wherein the respective average gains are assumed to be −11.5 dBi and −7.39 dBi.

Figure 6B:
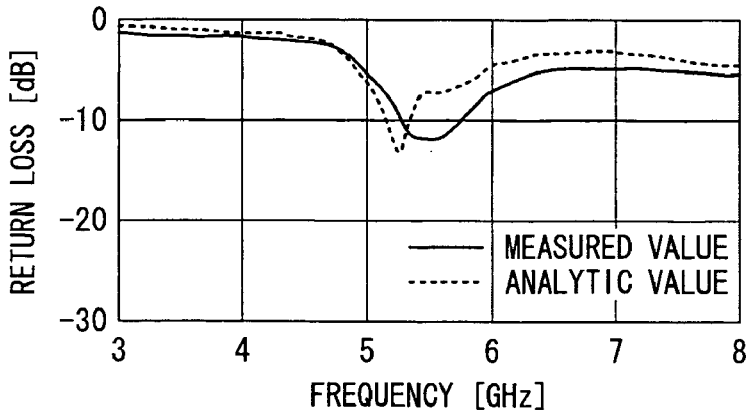

FIG. 6B is a view showing the input feature of the Yagi slot antenna 10 shown in FIG. 4B, wherein it may be also appreciated from the input feature in FIG. 6B that the Yagi slot antenna 10 causes the resonance with the length of the radiator 21 assumed to be about the ½ wavelength of the guide wavelength.

As described above, the Yagi slot antenna 10 of the embodiment of the present invention, provided that the driven element 11 of the basic slot antenna 1 as shown in FIG. 1A (FIG. 4A) is set to function as the radiator 21, performs a change of the electrical length of either of the parasitic elements 12 and 13 to set the parasitic element 12 to function as the director 22 and the parasitic element 13 to function as the reflector 23, or on the contrary, the parasitic element 12 to function as the reflector 23 and the parasitic element 13 to function as the director 22.

Figure 7A:
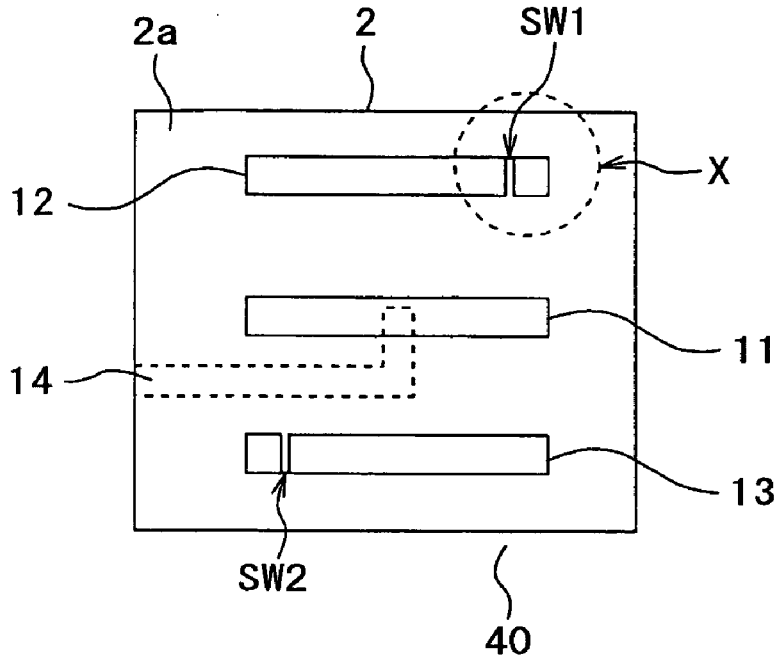
FIG. 7, consisting of FIG. 7A and FIG. 7B, is a view showing a configuration of a switch provided for the Yagi slot antenna of the embodiment of to the present invention.

Thus, the embodiment of the present invention is provided with switches SW1 and SW2 as changing means at prescribed positions of the parasitic elements 12 and 13 to change each electrical length of the parasitic elements 12 and 13, provided that each electrical length of the parasitic elements 12 and 13 is preliminarily set at the reflector length as shown in FIG. 7A. Then, the changing of each electrical length of the parasitic elements 12 and 13 from the reflector length to the director length is performed with the switches SW1 and SW2. In this case, the switches SW1 and SW2 are supposed to be at positions where each electrical length of the parasitic elements 12 and 13 reaches the director length.

Figure 7B:
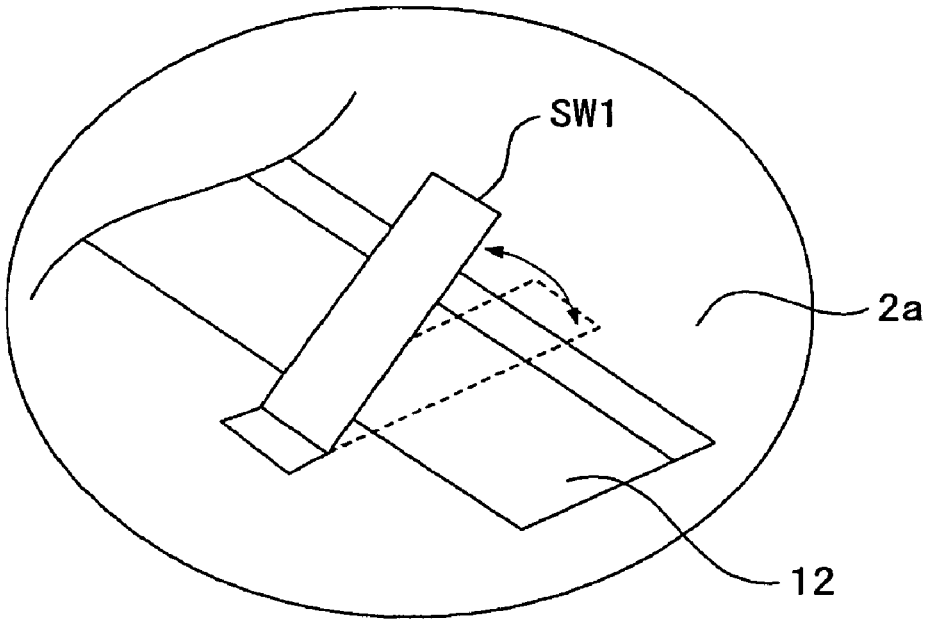

FIG. 7B is a view showing the configuration of the switch SW used for the above Yagi slot antenna 10. Incidentally, in FIG. 7B, there is shown the switch SW1 provided for the parasitic element 12. The switch SW1 shown in FIG. 7B is specified as a switch that has one end connected to the conductor 2*a* of the planar printed circuit board 2 and allows the other end to be switched over to either of an on state (a short-circuited state) making a connection to the conductor 2*a* and an off state (an open-circuited state) making no connection to the conductor 2*a*. Then, when the switch SW1 is placed in the short-circuited state, the electrical length of the parasitic element 12, for instance, may be changed from the reflector length to the director length. Incidentally, an MMIC (Monolithic Microwave IC) switch or a MEMS (Micro Electro Mechanical System) switch is supposed to be available for the switch SW1.

As described above, the embodiment of the present invention is provided with the switches SW1 and SW2 respectively at the prescribed positions of the parasitic elements 12 and 13 to ensure that the electrical length of either of the parasitic elements 12 and 13 is changed from the reflector length to the director length by the switches SW1 and SW2.

Figure 8A:
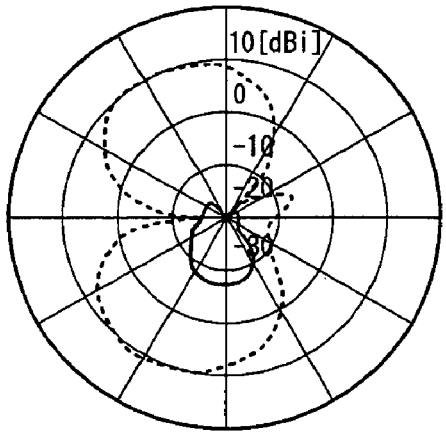
FIG. 8, consisting of FIGS. 8A, 8B, and 8C, is a view showing the directivity patterns of the Yagi slot antenna shown in FIG. 7.
Figure 8B:
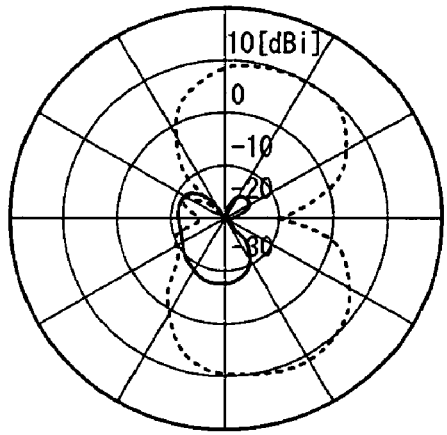
Figure 8C:
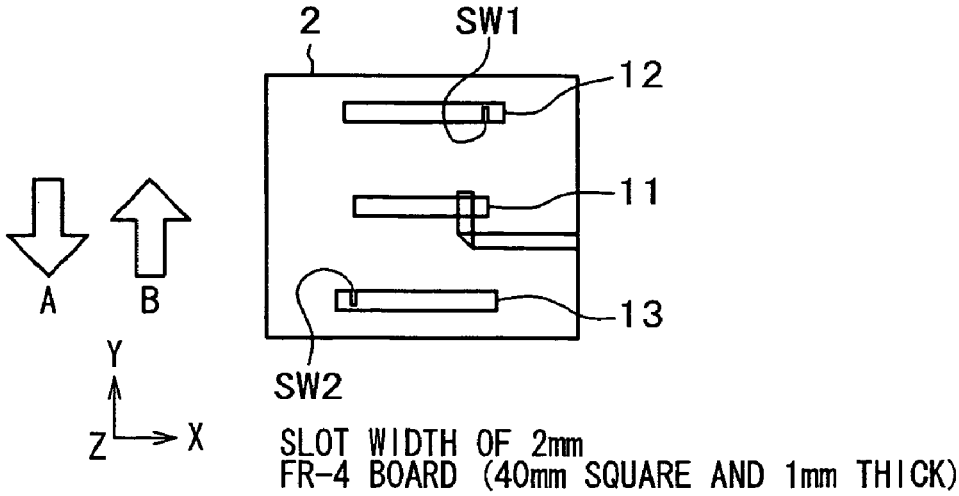

FIG. 8 is a view showing the directivity patterns of the Yagi slot antenna 10 shown in FIG. 7A. Specifically, in FIG. 8A, there is shown the directivity pattern obtained when only the switch SW2 of the parasitic element 13 is set to the on state, and in FIG. 8B, there is shown the directivity pattern obtained when only the switch SW1 of the parasitic element 12 is set to the on state. Incidentally, each of the directivity patterns in this case is also assumed to be one obtained when the planar printed circuit board 2 has thereon the parasitic element 12, the driven element 11 and the parasitic element 13 that are 2 mm in slot width and respectively 20.5 mm, 17 mm and 20.5 mm in slot length, as shown in FIG. 8C. The FR-4 board formed with the glass epoxy resin having the planar size of 40 mm×40 mm, the thickness of 1 mm and the dielectric constant of 4.2 as the material is also used for the planar printed circuit board 2. Further, each of the directivity patterns shown in FIGS. 8A and 8B is assumed to be one obtained when the length direction of the slot, the width direction of the slot and the thickness direction of the planar printed circuit board 2 are specified as the X-direction, the Y-direction and the Z-direction, respectively.

It may be appreciated from the directivity pattern of the Yagi slot antenna 10 shown in FIG. 8A that a setting of only the switch SW2 to the on state enables the directivity to be directed as shown by an arrow A in FIG. 8C. Further, it may be also appreciated that the setting of only the switch SW1 to the on state enables the directivity to be changed to a direction-as shown by an arrow B in FIG. 8C. That is, it may be understood that the setting of either of the switches SW1 and SW2 to the on state enables the directivity pattern to be changed.

According to the Yagi slot antenna of the embodiment of the present invention, the parasitic elements 12 and 13 may be used in common as the director or the reflector, so that the antenna apparatus having two different directivities may be configured with the single Yagi slot antenna 10. That is, the use of the parasitic elements 12 and 13 in common as the director and the reflector makes it possible to realize the antenna apparatus being small in size and having the two different directivities.

Further, the Yagi slot antenna 10 of the embodiment of the present invention eliminates the need to provide the switch SW for the driven element 11, resulting in no degradation of a radiation feature of the radiator. In addition, the Yagi slot antenna 10 of the embodiment of the present invention also eliminates the need to provide the phase shifter, unlike the conventional phased array antenna shown in FIG. 13, resulting in no degradation of the radiation feature of the radiator as well from this point of view.

Furthermore, according to the Yagi slot antenna 10 of the embodiment of the present invention, the driven element 11 operative as the radiator and the parasitic elements 12 and 13 operative as the director or the reflector may be formed directly on the conductor 2*a* of the planar printed circuit board 2, so that the antenna may reduce the thickness down to a level of a board thickness of the planar printed circuit board 2.

Moreover, the parasitic elements 12 and 13 operative as the director or the reflector are supposed to be formed on the conductor 2*a* of the planar printed circuit board 2, so that there is also an advantage of easily performing a packaging of components such as the switches SW1 and SW2 for changing each electrical length of the parasitic elements 12 and 13. In addition, the use of the dielectric substrate ensures that the effect of shortening the wavelength is obtained, resulting in an advantage of attaining a downsizing.

Figure 9:
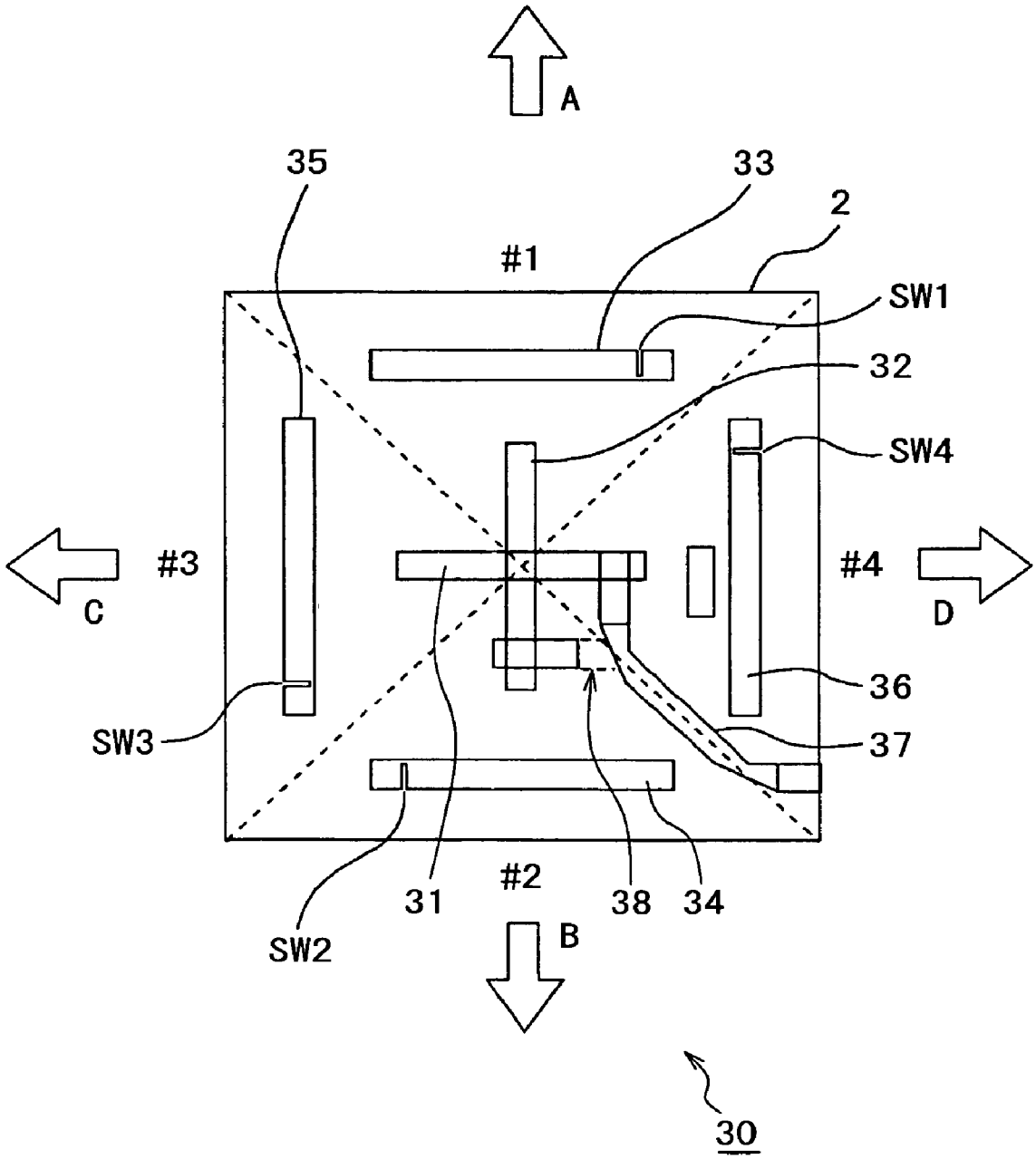
FIG. 9 is a view for illustrating the configuration of a Yagi slot antenna specified as another embodiment of the present invention.

FIG. 9 shows the structure of the antenna apparatus specified as another embodiment of the present invention. The above Yagi slot antenna 10 is provided as one capable of turning the directivity in two directions, that is, forward and backward directions, whereas a Yagi slot antenna 30 shown in FIG. 9 is supposed to be one capable of turning the directivity pattern in four directions, that is, forward, backward, leftward and rightward directions. In this case, the planar printed circuit board 2 has, at an approximately center position, a first driven element 31 positioned in a direction as illustrated, and before and behind the driven element 31, a first and a second parasitic elements 33 and 34 respectively given no feed. Further, the planar printed circuit board 2 has, at the approximately center position, a second driven element 32 orthogonal to the first driven element 31, and a third and a fourth parasitic elements 35 and 36 before and behind the second driven element 32. Then, the feed to either of the first and the second driven elements 31 and 32 is performed with a micro-strip transmission line 37 through a feed selector switch 38.

In this case, each slot length (the electrical length) of the first and the second driven elements 31 and 32 is set at a length equivalent to the ½ wavelength of the transmitting/receiving frequency. Further, each slot length of the first to the fourth parasitic elements 33 to 36 is set at the reflector length longer than each electrical length of the first and the second driven elements 31 and 32. Then, there are provided switches SW1, SW2, SW3 and SW4 at positions where each length of the first to the fourth parasitic elements 33 to 36 reaches the director length. Incidentally, each of the switches SW1 to SW4 is specified as the switch as shown in FIG. 7B.

Further, the first driven element 31 and the first and the second parasitic elements 33 and 34, and the second driven element 32 and the third and the fourth parasitic elements 35 and 36 are respectively spaced at intervals of ¼ wavelength, similar to the above.

That is, the Yagi slot antenna 30 shown in FIG. 9 is in the form of an orthogonal array of two Yagi slot antennas 10 as shown in FIG. 7A on the planar printed circuit board 2 at an angle of 90 degrees with regard to the other antenna.

The above Yagi slot antenna 30 may be set to operate as an antenna #1 having the directivity in a direction shown by an arrow A, provided that a control is performed by the switch SW1 of the first parasitic element 33 such that the electrical length of the first parasitic element 33 reaches the director length, while feeding to the first driven element 31 through a change-over of the feed selector switch 38. Further, it may be set to operate as an antenna #2 having the directivity in a direction shown by an arrow B, provided that the control is performed by the switch SW2 of the second parasitic element 34 such that the electrical length of the second parasitic element 34 reaches the director length, with the feed to the first driven element 31 in the similar manner.

Incidentally, it may be set to operate as an antenna #3 having the directivity in a direction shown by an arrow C, provided that the control is performed by the switch SW3 of the third parasitic element 35 such that the electrical length of the third parasitic element 35 reaches the director length, while feeding to the second driven element 32 through the change-over of the feed selector switch 38. Further, it may be set to operate as an antenna #4 having the directivity in a direction shown by an arrow D, provided that the control is performed by the switch SW4 of the fourth parasitic element 36 such that the electrical length of the fourth parasitic element 35 reaches the director length, while feeding to the second driven element 32 in the similar manner.

The above configuration ensures that the antenna apparatus having four different directivities is configured with the single Yagi slot antenna 30. Further, in this case, the first and the second parasitic elements 33 and 34 are used in common as the director or the reflector, and the third and the fourth parasitic elements 35 and 36 are used in common as the director or the reflector, so that the downsizing of the antenna apparatus may be attained.

Figure 10A:
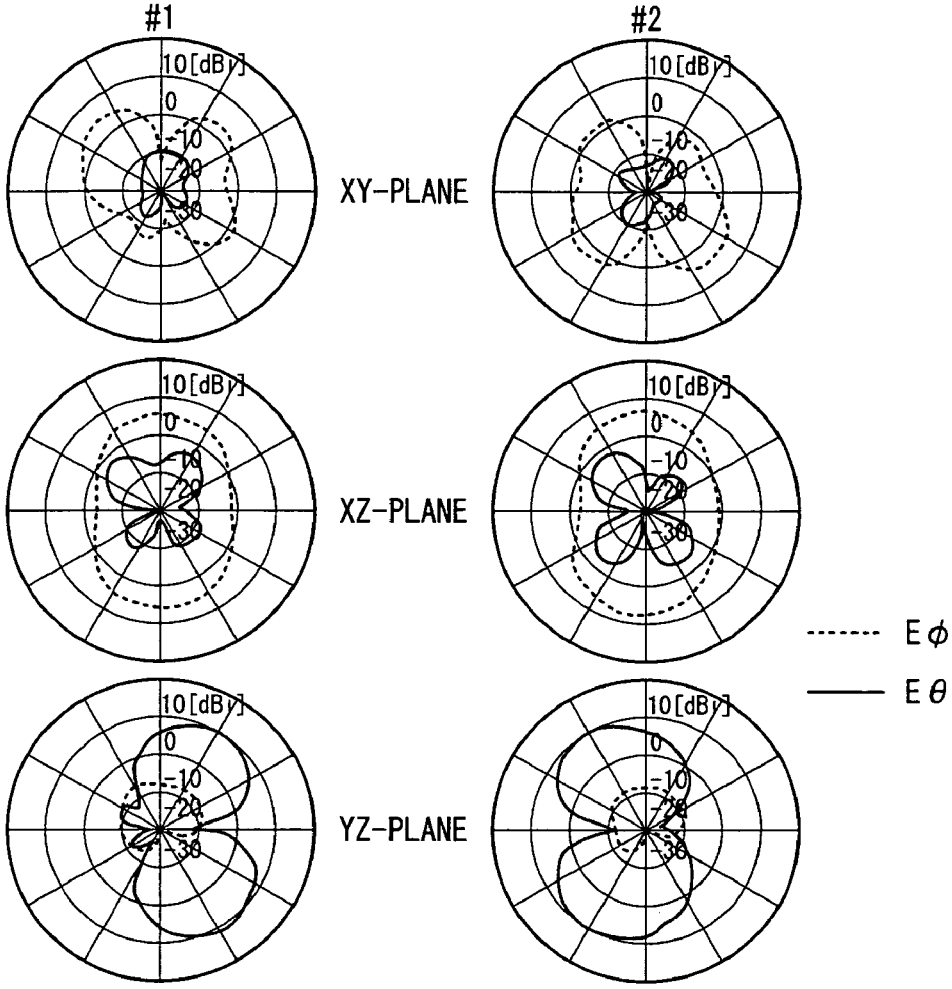
FIG. 10, consisting of FIG. 10A, and FIG. 10B, is a view showing the directivity patterns of the Yagi slot antenna specified as another embodiment.
Figure 10B:
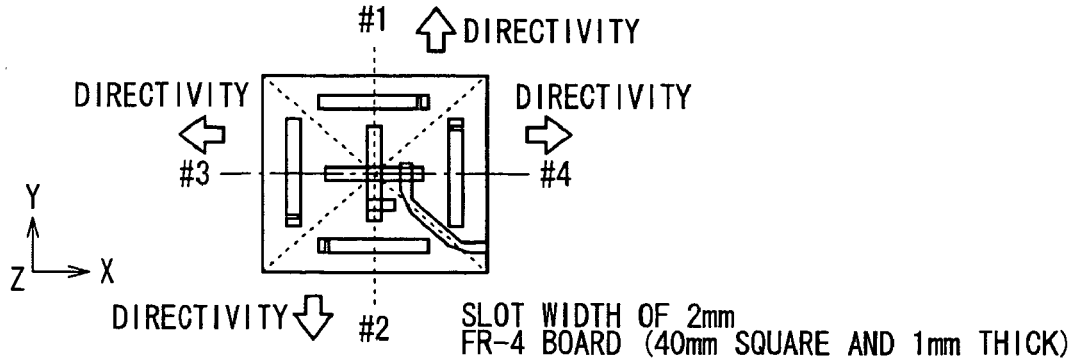
Figure 11A:
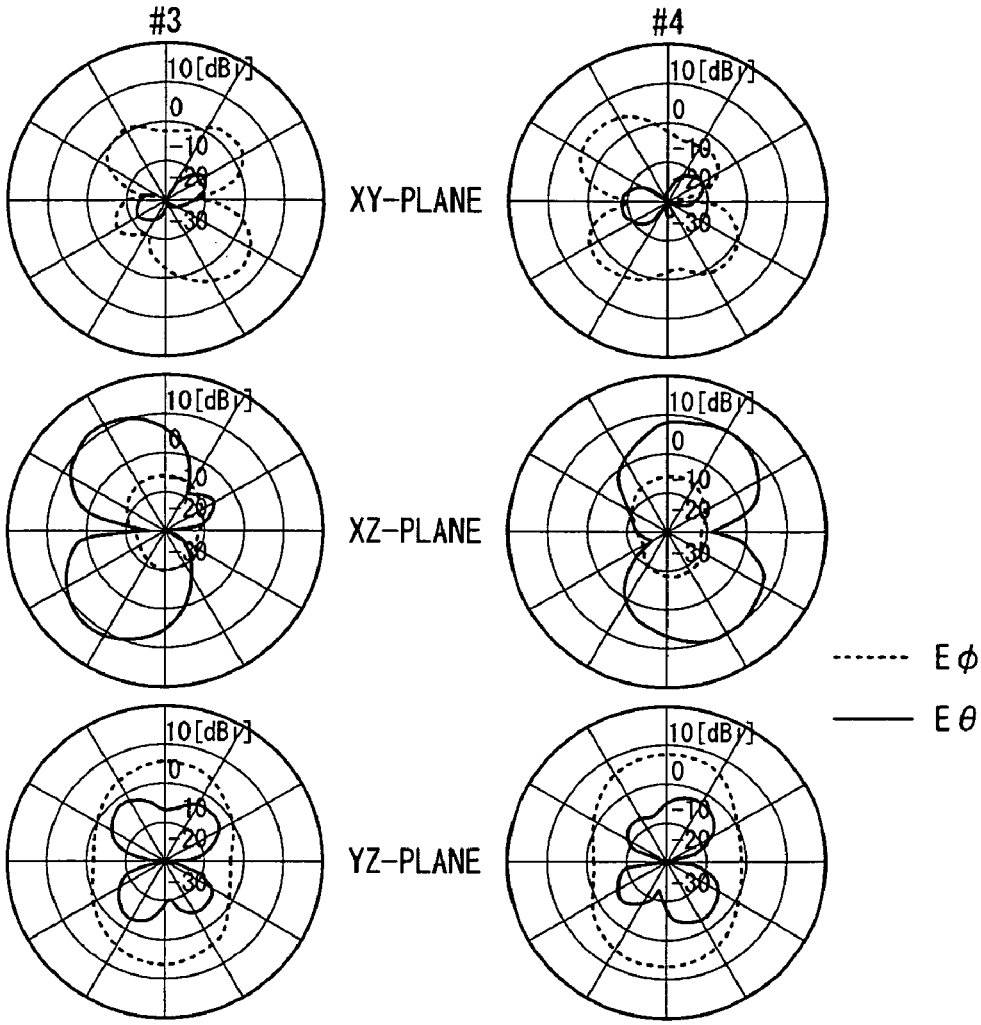
FIG. 11, consisting of FIG. 11A and FIG. 11B, is a view showing the directivity patterns of the Yagi slot antenna specified as another embodiment.
Figure 11B:
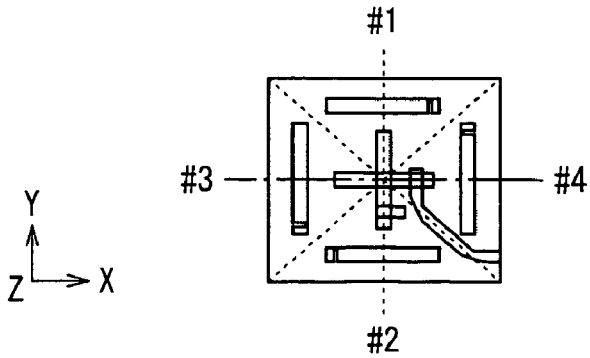

FIGS. 10 and 11 are views showing the directivity patterns of the Yagi slot antenna 30 shown in FIG. 9. Incidentally, the Yagi slot antenna 30 in this case is specified as an antenna in which the planar printed circuit board 2 has thereon the first and the second driven elements 31 and 32 that are respectively 2 mm in slot width and 17 mm in slot length, and the first to fourth parasitic elements 33 to 36 that are 20.5 mm in slot length, as shown in FIGS. 10B and 11B. The FR-4 board formed with the glass epoxy resin having the planar size of 40×40 mm, the thickness of 1 mm and the dielectric constant of 4.2 as the material is used for the planar printed circuit board 2. Further, each of the directivity patterns shown in FIG. 10A and FIG. 11A is assumed to be one obtained when the length direction of the slot, the width direction of the slot and the thickness direction of the planar printed circuit board 2 are specified as the X-direction, the Y-direction and the Z-direction, respectively.

In this case, the directivity patterns of the horizontal polarized wave Eϕ and the vertical polarized wave Eθ in the XY-plane, the XZ-plane and the YZ-plane at the time when setting the Yagi slot antenna 30 to function as the antenna #1 are given as shown in FIG. 10A, and an average gain thereof is assumed to be 3.402 dBi. Further, the directivity patterns of the horizontal polarized wave Eϕ and the vertical polarized wave Eθ in the XY-plane, the XZ-plane and the YZ-plane at the time when setting the above Yagi slot antenna 30 to function as the antenna #2 are given as shown in FIG. 10A, and the average gain thereof is assumed to be 2.692 dBi.

Furthermore, the directivity patterns of the horizontal polarized wave Eϕ and the vertical polarized wave Eθ in the XY-plane, the XZ-plane and the YZ-plane at the time when setting the above Yagi slot antenna 30 to function as the antenna #3 are given as shown in FIG. 11A, and the average gain thereof is assumed to be 3.337 dBi. Furthermore, the directivity patterns of the horizontal polarized wave Eϕ and the vertical polarized wave Eθ in the XY-plane, the XZ-plane and the YZ-plane at the time when setting the above Yagi slot antenna 30 to function as the antenna #4 are given as shown in FIG. 11A.

Then, in this case, it may be appreciated from the directivity patterns in the YZ-plane shown in FIGS. 10A and 10B and the directivity patterns in the XZ-plane shown in FIGS. 11A and 11B that the directivities in the four different directions are obtained by setting the Yagi slot antenna 30 to function as the antennas #1 to #4 respectively.

Figure 12:
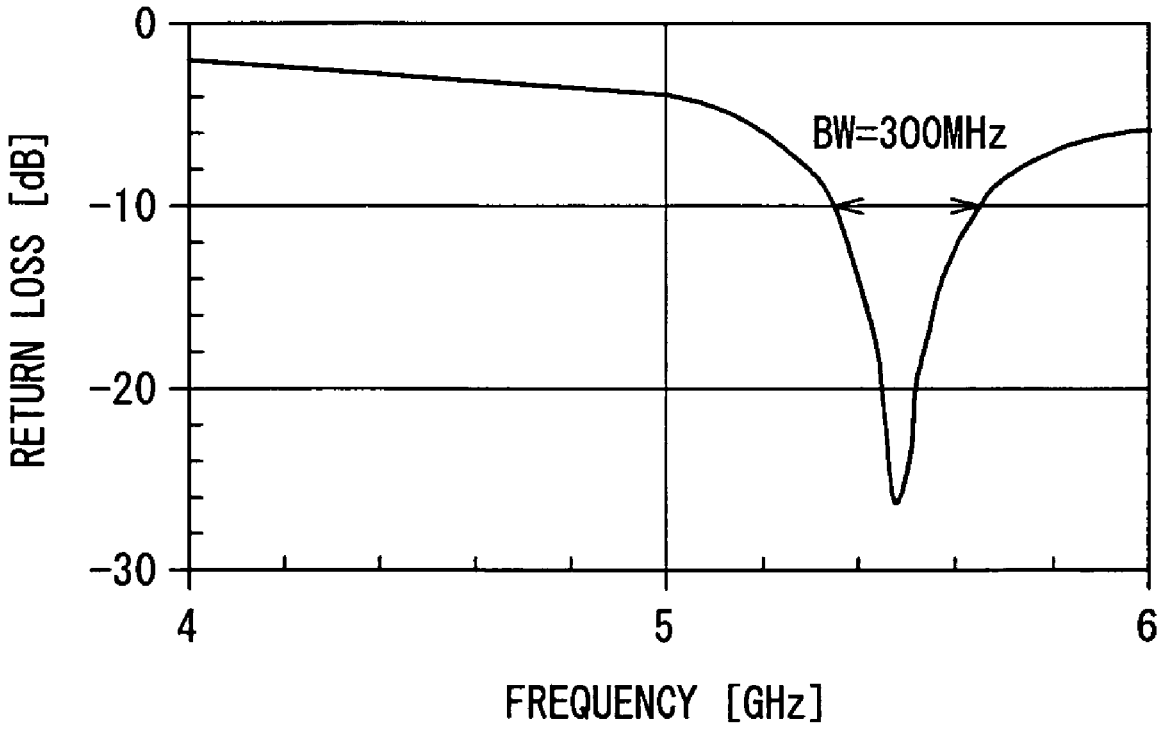
FIG. 12 is a view showing an input feature of the Yagi slot antenna specified as another embodiment.

FIG. 12 is a view showing an input feature of the Yagi slot antenna 30. It is apparent from FIG. 12 that a bandwidth BW of a band (where a return loss is equal to or smaller than −10 dB) assumed to obtain a satisfactory directivity pattern of the Yagi slot antenna 30 results in 300 MHz, and about 5% in terms of a bandwidth ratio. For the above reason, the Yagi slot antenna 30 of the embodiment of the present invention, when used for the radio communication such as the wireless LAN supposed to be in an available frequency bandwidth range of 5.15 GHz to 5.35 GHz may be set to function as a satisfactory antenna.

FIG. 13 is a table showing maximum gains and average gains of the Yagi slot antenna 30 of the embodiment of the present invention and a reference antenna (a dipole antenna). In the case of the Yagi slot antenna 30 of the embodiment of the present invention, it is apparent from FIG. 13 that in each of the antennas #1 to #4, there is a gain difference by 3 dB or above between the average gains other than the average gain in a radial direction, that is, the average gains in the XY-plane, the XZ-plane and the YZ-plane and the average gain in the radial direction. For the above reason, it may be appreciated that when the reception is detected with the Yagi slot antenna 30 of the embodiment of the present invention, the maximum gain in the radial direction is obtained, so that the transmission of the radio waves in that direction leads to a possibility of restraining any unnecessary wave.

Figure 14A:
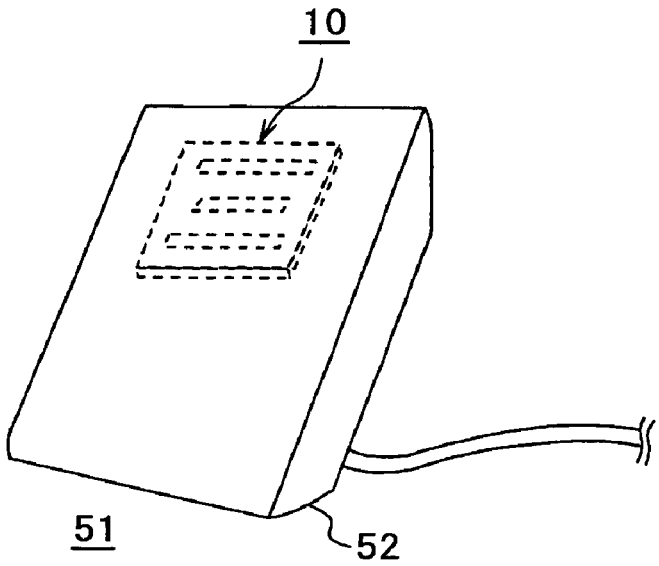
FIG. 14, consisting of FIG. 14A and FIG. 14B, is a view showing an electronic apparatus mounted with the Yagi slot antenna of the embodiment of the present invention.
Figure 14B:
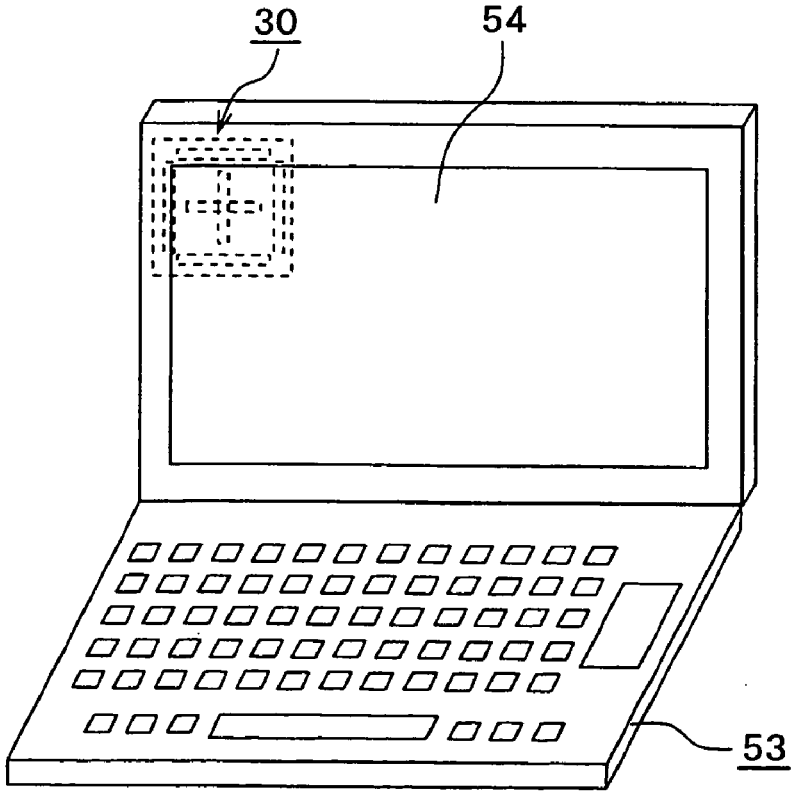
Figure 15:
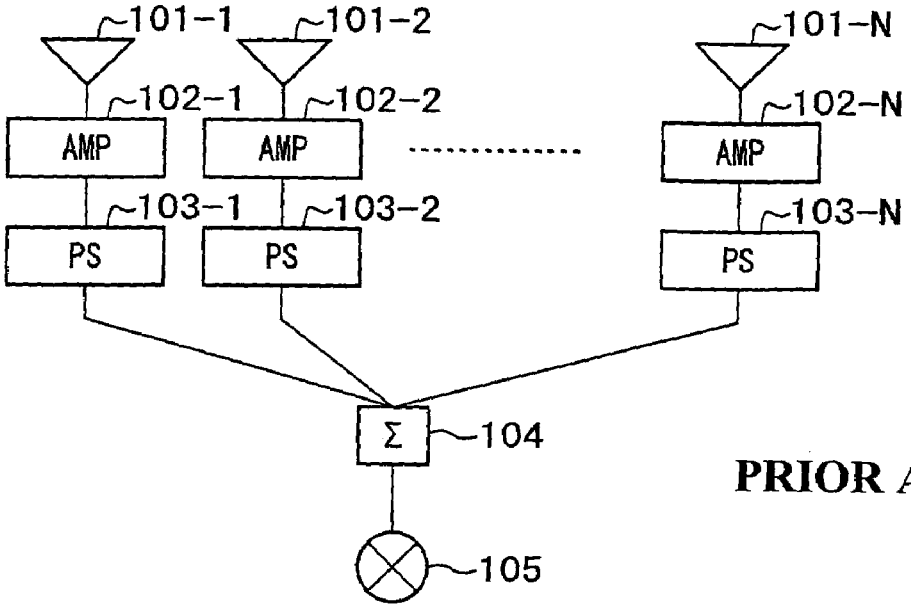
FIG. 15 is a block diagram showing the configuration of a conventional phased array antenna.
Figure 16:
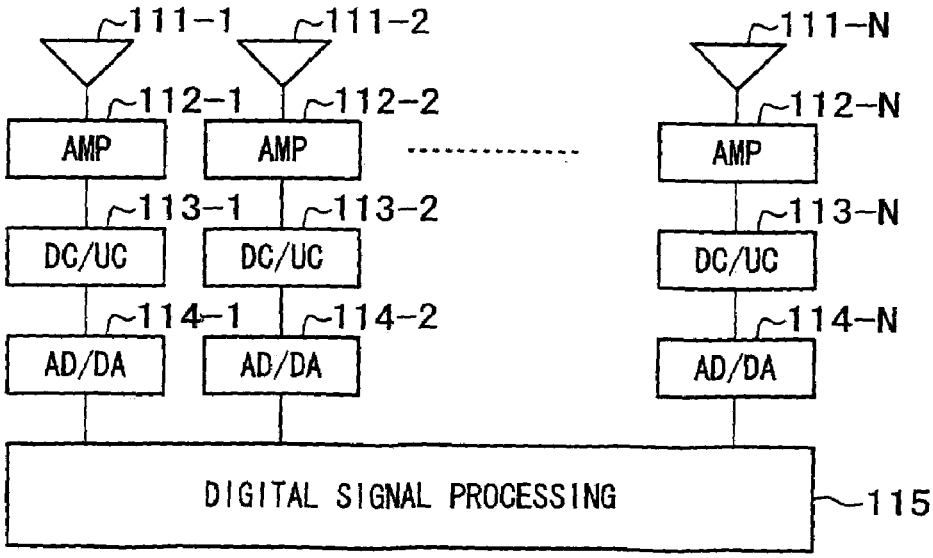
PRIOR ART FIG. 16
FIG. 16 is a block diagram showing the configuration of a conventional adaptive array antenna.
Figure 17A:
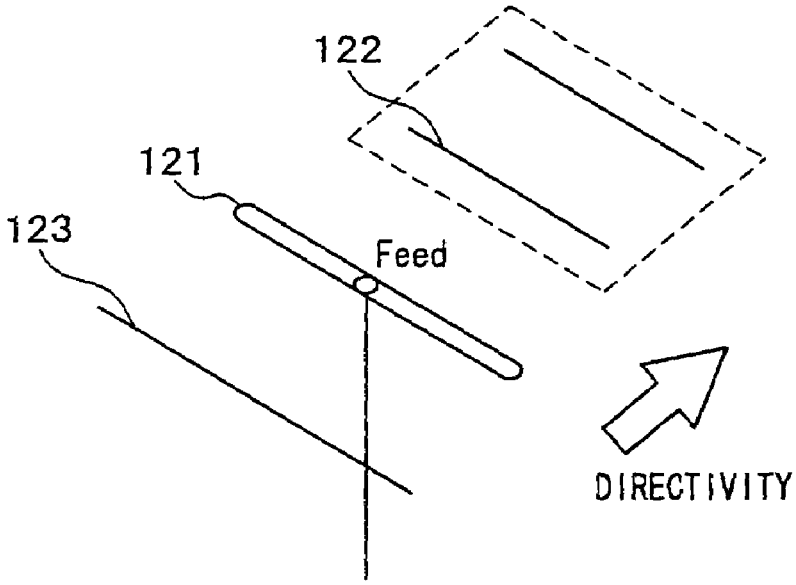
FIG. 17, consisting of FIG. 17A and FIG. 17B, is a view showing the configuration of a conventional Yagi-Uda antenna.
Figure 17B:
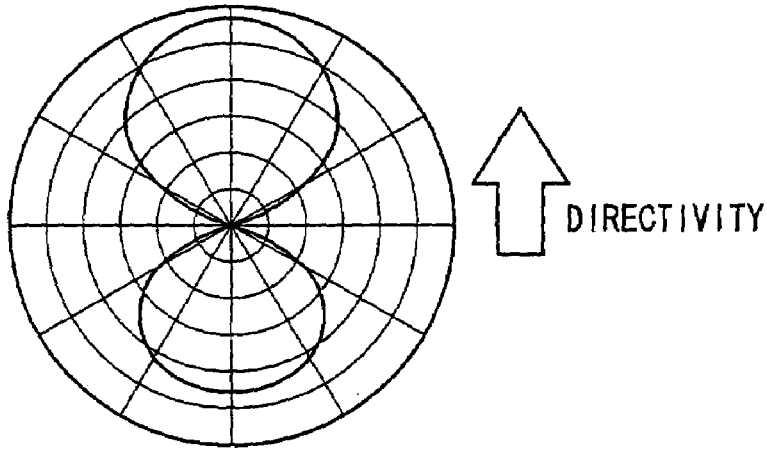
PRIOR ART FIG. 17B

Thus, a mounting of the Yagi slot antenna 30 of the embodiment of the present invention in an apparatus body 52 of a wireless LAN base station apparatus 51 available at any place irrespective of indoor and outdoor places as shown in FIG. 14A, in a mobile information terminal 53 such as a notebook-type personal computer as shown in FIG. 14B or in a non-illustrated wireless television receiver makes it possible to restrain the interference wave caused by the reflection from the wall etc. without increasing the number of transmitting/receiving systems. It is a matter of course that the mounting of the Yagi slot antenna 10 as shown in FIG. 7A in the wireless LAN base station apparatus 51 or in the mobile information terminal 53 obtains the same effects as above.

Incidentally, while the Yagi slot antennas 10 and 30 having been described above respectively limit the number of the parasitic elements for forming the director or the reflector to one, this is merely given as one instance, and it is also allowable to form the director or the reflector with more than one parasitic element. Further, while the embodiment of the present invention has been described by taking the case of the antenna configured on the basis of the slot antenna, it is a matter of course that the above antenna may be also configured on the basis of antennas other than the slot antenna.

What is claimed is:

1. An antenna apparatus comprising:

a driven element having a prescribed length;

parasitic elements respectively having a length longer than that of said driven element and disposed at opposite sides of said driven element; and changing means for changing each length of said parasitic elements, and further comprising a plurality of antenna apparatuses each having said driven element, said parasitic elements, and said changing means, said plurality of said antenna apparatuses being disposed at different angles.

2. The antenna apparatus according to claim 1, wherein directivity is varied by changing the length of said parasitic elements using said changing means.

3. The antenna as defined in claim 1 wherein each driven element and said parasitic elements respectively have electrically and mechanically different lengths.

4. The antenna as defined in claim 1 wherein each driven element is in circuit with a transmission line, and each parasitic element is characterized as not having a feed connection.

5. The antenna apparatus according to claim 1, wherein said driven element and said parasitic elements are each configured by forming a slot respectively on a conductor.

6. The antenna apparatus according to claim 5 wherein a slot forming said driven element has a slot length equivalent to a ½ wavelength of a transmitting/receiving frequency required for the slot antenna.

7. The antenna as defined in claim 6 wherein each slot length of the parasitic elements is spaced at intervals of about ¼ wavelength of a free space wavelength respectively.

8. A slot antenna, comprising:

a substantially planar, conductive printed circuit board acting as a ground plane, having, at approximately a center thereof, a driven element in the form of a slot having a prescribed length for radiating waves therefrom, and at least a pair of spaced parasitic elements in the form of slots on opposite sides of said driven element, said driven element given a feed, said parasitic elements characterized as lacking a feed, a slot length of the driven element is a length equivalent to a ½ wavelength of a transmitting/receiving frequency required for the slot antenna to perform a transmission and a reception, and further including means for changing a length of either of said parasitic elements.

9. The slot antenna set forth in claim 8 wherein said parasitic elements are located at spaced intervals from said driven element of about ¼ wavelength of the free space wavelength.

* * * * *